US008950415B1

(12) United States Patent
Spletzer et al.

(10) Patent No.: US 8,950,415 B1
(45) Date of Patent: Feb. 10, 2015

(54) CRUTCH SYSTEM

(76) Inventors: Barry Spletzer, Albuquerque, NM (US); Richard E. Fate, Albuquerque, NM (US)

( * ) Notice: Subject to any disclaimer, the term of this patent is extended or adjusted under 35 U.S.C. 154(b) by 246 days.

(21) Appl. No.: 13/481,126

(22) Filed: May 25, 2012

(51) Int. Cl.
*A45B 9/00* (2006.01)

(52) U.S. Cl.
USPC ..... 135/74

(58) Field of Classification Search
USPC ..... 135/127, 114, 65, 74, 76; 403/118, 299, 403/296, 307
See application file for complete search history.

(56) References Cited

U.S. PATENT DOCUMENTS

| | | | | |
|---|---|---|---|---|
| 2,508,039 | A * | 5/1950 | Neuwirth | 248/188.5 |
| 3,448,748 | A * | 6/1969 | Louis | 135/127 |
| 4,440,391 | A * | 4/1984 | Saenz et al. | 482/148 |
| 6,073,642 | A * | 6/2000 | Huang | 135/114 |
| 6,371,865 | B1 * | 4/2002 | Magliulo | 473/256 |
| 6,447,404 | B1 * | 9/2002 | Wilbur | 473/296 |
| 6,764,413 | B2 * | 7/2004 | Ho | 473/288 |
| 6,811,347 | B1 * | 11/2004 | Hsieh | 403/300 |
| 7,434,592 | B2 * | 10/2008 | Larson et al. | 135/73 |
| 7,607,865 | B2 * | 10/2009 | Gregory et al. | 405/251 |
| 7,841,353 | B2 * | 11/2010 | Lee | 135/74 |
| 2012/0167935 | A1 * | 7/2012 | Lee | 135/120.3 |

* cited by examiner

*Primary Examiner* — David R Dunn
*Assistant Examiner* — Danielle Jackson

(57) ABSTRACT

Cylindrical first and second components have a joint between the components. The joint includes a male coupler with a first extent slidably received in the second component and a second extent formed with male coupling threads. Female carrier threads are provided on the male coupler. The joint also includes a female coupler slidably received in the first component. The female coupler has female carrier threads. The female coupler has female coupling threads adapted to removably couple with the male coupling threads of the male coupler. Tubular carriers have ends. Carrier threads are removably received in the carrier threads of the couplers. An elastic member has a central region located within the threads of the couplers and extending through the upper and lower carriers.

1 Claim, 2 Drawing Sheets

FIG. 3
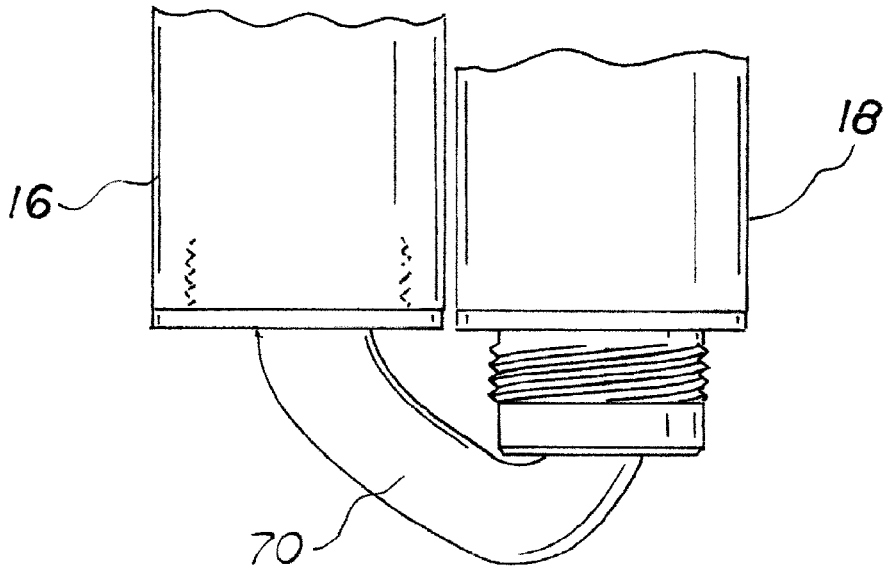
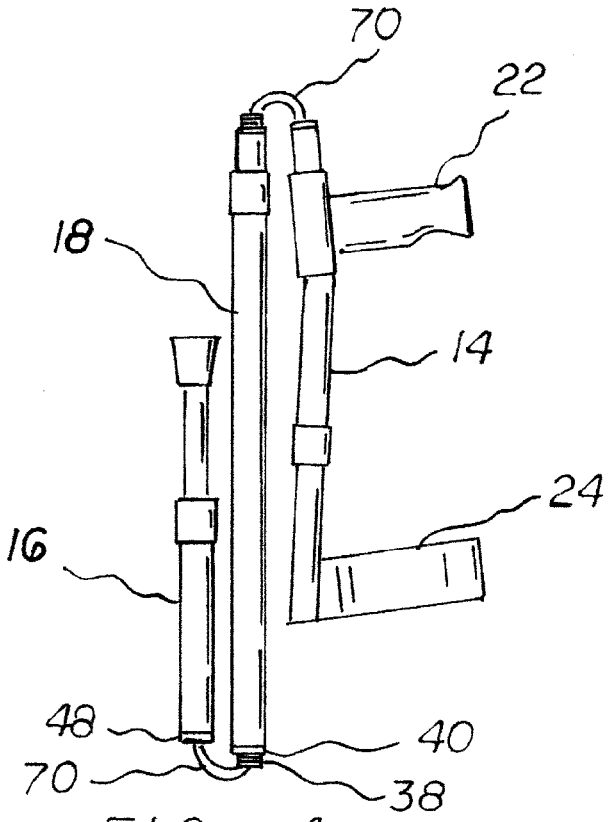
FIG. 4

CRUTCH SYSTEM

BACKGROUND OF THE INVENTION

Field of the Invention

The present invention relates to a crutch system and more particularly pertains to assembly and disassembly purposes, the assembly and the disassembly of the crutch system adapted to be done in a simple, safe, rapid and economical manner.

SUMMARY OF THE INVENTION

In view of the disadvantages inherent in the known types of crutch systems of known designs and configurations now present in the prior art, the present invention provides an improved crutch system. As such, the general purpose of the present invention, which will be described subsequently in greater detail, is to provide a new and improved crutch system and method which has all the advantages of the prior art and none of the disadvantages. The present also invention allows for rapid assembly and disassembly for a very portable crutch system while maintaining full strength of a single piece crutch.

To attain this, the present invention essentially comprises a crutch system. Cylindrical first and second components have a joint between the components. The joint includes a male coupler. The male coupler has a first extent slidably received in the second component with lead in portions for effecting alignment of the coupler threads. The male coupler has a second extent formed with male coupling threads. Female carrier threads are provided on the male coupler. The joint also includes a female coupler slidably received in the first component with lead in portions for effecting alignment of the coupler threads. The female coupler has female carrier threads. The female coupler has female coupling threads adapted to removably couple with the male coupling threads of the male coupler. Tubular carriers have ends. Carrier threads are removably received in the carrier threads of the couplers. An elastic member has a central region located within the threads of the couplers and extending through the upper and lower carriers.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved crutch system which has all of the advantages of the prior art crutch systems of known designs and configurations and none of the disadvantages.

It is another object of the present invention to provide a new and improved crutch system which may be easily and efficiently manufactured and marketed.

It is further object of the present invention to provide a new and improved crutch system which is of durable and reliable constructions.

An even further object of the present invention is to provide a new and improved crutch system which is susceptible of a low cost of manufacture with regard to both materials and labor, and which accordingly is then susceptible of low prices of sale to the consuming public, thereby making such crutch system economically available to the buying public.

Even still another object of the present invention is to provide a crutch system for assembly and disassembly purposes, the assembly and the disassembly of the crutch system adapted to be done in a simple, safe, rapid and economical manner.

Lastly, it is an object of the present invention to provide a new and improved crutch system. Cylindrical first and second components have a joint between the components. The joint includes a male coupler. The male coupler has a first extent slidably received in the second component. The male coupler has a second extent formed with male coupling threads. Female carrier threads are provided on the male coupler. The joint also includes a female coupler slidably received in the first component. The female coupler has female carrier threads. The female coupler has female coupling threads adapted to removably couple with the male coupling threads of the male coupler. Tubular carriers have ends. Carrier threads are removably received in the carrier threads of the couplers. An elastic member has a central region located within the threads of the couplers and extending through the upper and lower carriers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an enlarged side elevational view taken at Circle 2 of FIG. 1 but with the lower and intermediate components uncoupled.

FIG. 4 is a side elevational view of the system but with the upper and lower and intermediate components uncoupled.

The same reference numerals refer to the same parts throughout the various Figures.

DESCRIPTION OF THE PREFERRED EMBODIMENT

Figure 1:
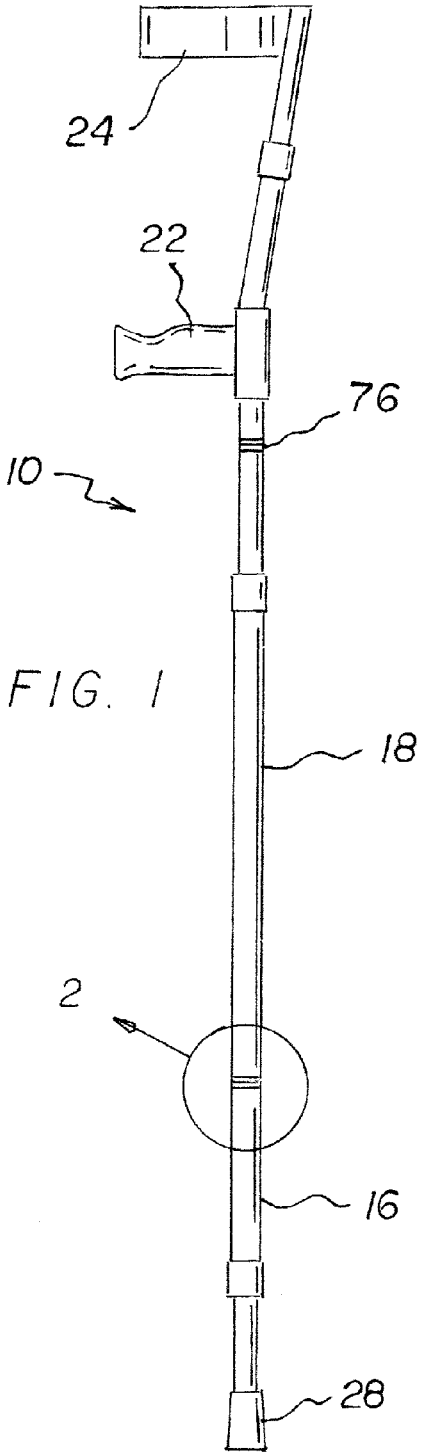
FIG. 1 is a side elevational view of a crutch system constructed in accordance with the principles of the present invention.

With reference now to the drawings, and in particular to FIG. 1 thereof, the preferred embodiment of the new and improved crutch system embodying the principles and concepts of the present invention and generally designated by the reference numeral 10 will be described.

The present invention, the crutch system 10 is comprised of a plurality of components. Such components in their broadest context include cylindrical first and second components and tubular carriers. Such components are individually configured and correlated with respect to each other so as to attain the desired objective.

First provided is a cylindrical upper component 14. The upper component has an upper end and a lower end. A cylindrical lower component 16 is provided. The lower component has an upper end and a lower end. A cylindrical intermediate component 18 is provided. The intermediate component has an upper end and a lower end. A top joint is provided between the upper end of the intermediate component and the lower end of the upper component. A bottom joint is provided between the lower end of the intermediate component and the upper end of the lower component. The upper and lower and intermediate components are generally vertically oriented in axial alignment during use. The components are hollow. The components are in a cylindrical configuration. The components have an interior diameter and an exterior diameter. The components are fabricated of a rigid material.

A handle 22 is provided. The handle is provided above. A forearm support 24 is provided. The forearm support is provided below. The forearm support extends generally horizontally from the upper component.

An elastomeric tip 28 is provided. The elastomeric tip is removably received on the lower component at the lower end.

The bottom joint includes a male coupler 32. The male coupler has a first extent 34. The first extent has an exterior diameter. The exterior diameter of the first extent is slidably received in the lower end of the intermediate component. The male coupler has a second extent 36. The second extent has an exterior diameter. The exterior diameter of the second extent is less than the exterior diameter of the first extent. The male coupler has a quadruple-lead male thread 38. The male coupler terminates below with a lead in. The male coupler has an outwardly extending annular collar 40. The annular collar is provided between the first and second extents. The annular collar is provided in contact with the lower end of the intermediate component. The annular collar has an exterior diameter. The exterior diameter of the annular collar is equal to the exterior diameter of the lower component. Female carrier threads 42 are provided. The female carrier threads are provided on the first extent of the male carrier.

The bottom joint also includes a female coupler 46. The female coupler has an exterior diameter. The exterior diameter of the female coupler is slidably received in the upper end of the lower component. The female coupler has an outwardly extending annular collar 48. The annular collar is provided at the upper end of the female coupler. The annular collar is provided in contact with the upper end of the lower component. The outwardly extending annular collar has an exterior diameter. The exterior diameter of the annular collar is equal to the exterior diameter of the lower component. The female coupler has an inwardly extending annular collar. Female carrier threads 50 are provided. The female coupler has an interior diameter. The interior diameter of the female coupler is less than the interior diameter of the intermediate component. The female coupler has a quadruple-lead female coupling thread 52. The thread is adapted to removably couple with the male coupling threads of the male coupler.

An elongated lower tubular carrier 56 is provided. The lower tubular carrier is fabricated of a rigid material. The lower tubular carrier has an upper end. The upper end of the lower tubular carrier has male carrier threads 58. The threads are adapted to be removably received in the female carrier threads of the male coupler 32.

Provided next is an elongated upper tubular carrier 62. The upper tubular carrier is fabricated of a rigid material. The upper tubular carrier has a lower end. The lower end of the upper tubular carrier has male carrier threads 64. The threads are adapted to be removably received in the female carrier threads of the female coupler 46. A castellated collar 66 is provided. The castellated collar is coupled to the upper end of the lower tubular member.

Further provided is an elastic member 70. The elastic member has a central region. The central region is located within the threads of the male and female couplers. The central region extends through the upper and lower tubular carriers. The elastic member has enlarged ends 72. The enlarged ends are located above the upper tubular carrier and below the lower tubular carrier. The elastomeric member is adapted to urge together the components when threadedly coupled. The elastomeric member is further adapted to keep the components together when not threadedly coupled. The elastomeric member is fabricated of an elastomeric material. The elastomeric material is chosen from the class of elastomeric materials. The class of elastomeric materials includes plastic and rubber, natural and synthetic, and blends thereof.

Provided last is an upper joint 76. The upper joint is provided between the upper and intermediate components. The upper joint is constructed as the lower component but inverted with the male thread. The upper joint extends upwardly from the intermediate components and with the female threads in the upper component.

A crutch joint is described herein that provides simple rigid assembly and disassembly while developing strength and stiffness on par with a standard, one-piece, tubular crutch. By using two of these joints in a standard crutch, a pair of crutches can be folded in a matter of seconds to total length of less than 18 inches.

The crutch joint uses a combination of a multiple lead thread and an elastic member to produce the desired result. This is the heart of the invention.

A typical single lead thread provides a single carry entry point and a lead, advance per revolution, equal to the pitch, spacing between the adjacent threads. In a multiple lead thread, the lead is the product of the pitch and the number of threads.

A 4-lead thread is used here although other numbers of leads, even perhaps as low as two could provide some or all of the advantages cited here. To be clear, here is one of our male couplers with a single one of the threads highlighted in red.

With typical threads, the highlighting would cover all the threads. Here there are four separate threads.

The current embodiment uses a 4-lead 20 pitch threads so the thread spacing is 0.05 inches but the lead is 0.20 inches. This provides several advantages.

1. The greater lead brings the parts together with less turning.

2. Multiple leads mean the male and female threads engage at multiple points around the circumference. This produces a higher strength joint with much less rotation. For example, with a single lead thread engaged for one-half revolution, there is only engagement alone one-half of the circumference. The resulting joint is weak in bending. With a 4-lead thread, there are four, equally-spaced, half-circumference engagements providing a full, two-thread engagement at all points around the circumference producing a very strong joint.

3. The multiple leads reduce the amount of turning before the start of thread engagement. On a single thread, it can require up to a full rotation to align the thread starts and begin engagement. With a 4-lead thread, the maximum is ¼ turn. Further, due to thread beveling on the entry, a full pitch of depth has a less-than-full depth thread. This is again a full turn on a single thread and ¼ turn on a 4-lead thread. This all means that, to achieve a single pitch of full thread engagement on a single thread can take up to 3 revolutions but only ¾ revolutions on a 4-lead thread.

4. Even though the joint is self tightening, the high lead reduces the wedging effect of the thread so it does not overtighten and can be easily loosened by hand regardless of the loading history.

Figure 2:
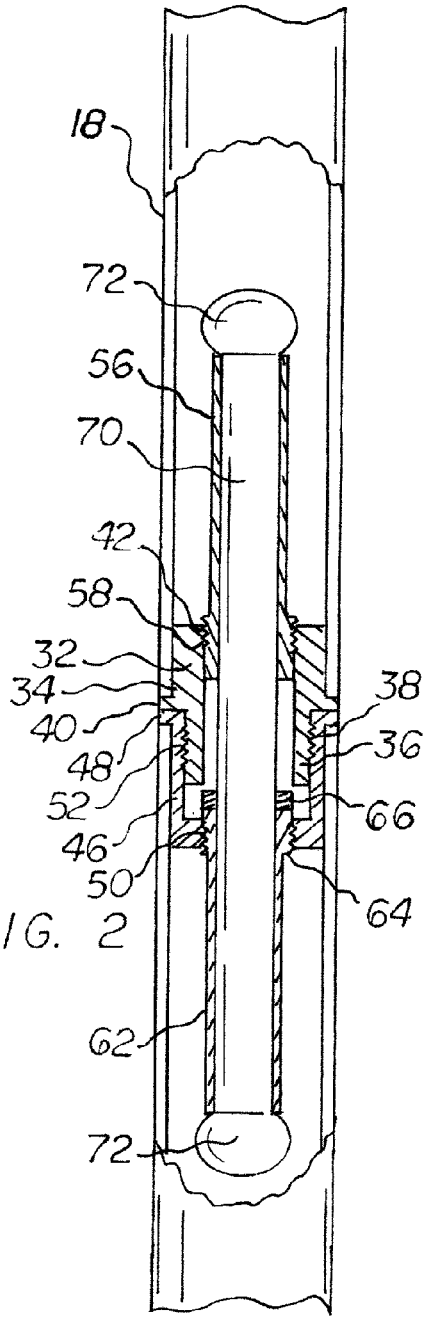
FIG. 2 is an enlarged side elevational view taken at Circle 2 of FIG. 1 but with parts broken away to show certain internal constructions.

The details of the crutch joint are shown in cross-section of FIG. 2.

The coupler materials must be reasonably low friction or lightly lubricated to allow the self-tightening action to perform properly. Here the male and female couplers are 360 brass. The couplers fit inside the tube if the tube is large enough, about 1-inch OD for 360 brass coupler and aluminum tubing, so that the threaded coupling can be designed with strength comparable to the crutch tube.

The female coupler has a thread relief region that, with the overall length of male thread, determines the length of thread engagement. This can be adjusted to provide a balance between sufficient engagement and rapid operation. The relief region also helps align the threads to prevent cross threading. Most of the thread alignment is provided by the lead-in on the male coupler. In addition, the force produced by the elastic member tends to help with alignment.

The diameter is actually below the root diameter of the external thread. There is no special reason to match the root diameter. The only important factors to have reasonably tight tolerance between the mating unthreaded portions of the male and female couplers. The reason to go below the root diameter is to assure clearance with the minor diameter of the mating internal thread and to make cutting of the external thread easier. Since this part does not carry a load, a thinner wall in acceptable here.

The threads in the current embodiment are derived from standard UTS thread form for ¾-20 thread but the major diameter is slightly larger, 0.77 inches, to produce equal bending strength in the male and female thread sections. The threads have a standard 30 degree bevel. This effectively produces a tapered thread depth over one pitch length of depth. For more rapid engagement and less chance of cross threading, this could be changed by removing the taper section entirely, leaving an abrupt edge to the thread.

The elastic carriers provide enough free length for the elastic member to allow enough stretch to separate the joint and fold the crutch. The elastic material currently is latex surgical tubing. The carriers thread into the couplers from the open ends and are installed/removed by means of the castellated collar allowing the elastic member to be replaced without removing the couplers from the crutch.

In another matter, an alternate design replaces the latex tubing with a metal spring that is completely enclosed within the carrier. The exposed portion then is a non-elastic but flexible connector such as a nylon cord.

The couplers are permanently attached into the crutch tubes but are adapted to be removably coupled via threads as well. A swaged joint and/or epoxied joint are important alternatives. A swaged and/or epoxied joint assures that the parts cannot become loose. For ease of manufacturing, swaged and/or epoxied joints are preferred.

FIGS. 3 and 4 show the joint when separated with parts only connected by the elastic member.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A crutch system (10) having twist-lock crutch joints for assembly and disassembly purposes, the assembly and the disassembly of the crutch system adapted to be done in a simple, safe, rapid and economical manner, the crutch system comprising, in combination:

a cylindrical upper component (14) having an upper end and a lower end, a cylindrical lower component (16) having an upper end and a lower end, a cylindrical intermediate component (18) having an upper end and a lower end, a top joint between the upper end of the intermediate component and the lower end of the upper component, a bottom joint between the lower end of the intermediate component and the upper end of the lower component, the upper and lower and intermediate components being generally vertically oriented in axial alignment during use, the components being hollow in a cylindrical configuration with an interior diameter and an exterior diameter, the components being fabricated of a rigid material;

a handle (22) above and a forearm support (24) below extending generally horizontally from the upper component;

an elastomeric tip (28) removably received on the lower component at the lower end;

the bottom joint including a male coupler (32) having a first extent (34) with an exterior diameter slidably received in the lower end of the intermediate component, the male coupler having a second extent (36) with an exterior diameter less than the exterior diameter of the first extent and formed with multiple-lead male thread (38) and terminating below with a lead in, an outwardly extending annular collar (40) formed between the first and second extents in contact with the lower end of the intermediate component, the annular collar having an exterior diameter equal to the exterior diameter of the lower component, female carrier threads (42) on the first extent of the male coupler;

the bottom joint also including a female coupler (46) having an exterior diameter slidably received in the upper end of the lower component, an outwardly extending annular collar (48) formed at the upper end of the female coupler in contact with the upper end of the lower component, the outwardly extending annular collar having an exterior diameter equal to the exterior diameter of the lower component, the female coupler having an inwardly extending annular collar with female carrier threads (50), the female coupler having an interior diameter less than the interior diameter of the intermediate component and formed with quadruple-lead female coupling thread (52) adapted to removably couple with the male coupling threads of the male coupler;

an elongated lower tubular carrier (56) fabricated of a rigid material, the lower tubular carrier having an upper end with male carrier threads (58) adapted to be removably received in the female carrier threads of the male coupler (32);

an elongated upper tubular carrier (62) fabricated of a rigid material, the upper tubular carrier having a lower end with male carrier threads (64) adapted to be removably received in the female carrier threads of the female coupler (46), a castellated collar (66) coupled to the upper end of the lower tubular carrier;

an elastic member (70) having a central region located within the threads of the male and female couplers and extending through the upper and lower tubular carriers, the elastic member having enlarged ends (72) located above the upper tubular carrier and below the lower tubular carrier, the elastomeric member adapted to urge together the components when threadedly coupled and to keep the components together when not threadedly coupled, the elastomeric member being fabricated of an elastomeric material chosen from the class of elastomeric materials including plastic and rubber, natural and synthetic, and blends thereof; and the top joint (76) being constructed as the bottom joint but inverted with the male thread extending upwardly from the intermediate component and with the female threads in the upper component.

* * * * *